United States Patent [19]

Canty et al.

[11] 4,217,717

[45] Aug. 19, 1980

[54] AUTOMATIC WEAPON SIMULATOR

[75] Inventors: Michael P. Canty, Bloomington, Ind.; Don W. Caudy, Dublin; Donald J. Hackman, Columbus; Jeremy M. Harris, Worthington; Robert W. Mowery, Columbus; George R. Riley, Grove City; Beverly D. Trott, Columbus, all of Ohio

[73] Assignee: The United States of America as represented by the Secretary of the Navy, Washington, D.C.

[21] Appl. No.: 787,726

[22] Filed: Apr. 11, 1977

[51] Int. Cl.[3] ..... F41C 27/00

[52] U.S. Cl. ..... 42/1 R; 42/84; 89/1 R; 102/200

[58] Field of Search ..... 42/1 R, 84; 89/1 R, 89/1 B, 1 L, 1.814, 135; 102/70.2 R

[56] References Cited

U.S. PATENT DOCUMENTS

| | | | |
|---|---|---|---|
| 2,836,919 | 6/1958 | DuBois | 42/1 R |
| 3,208,350 | 9/1965 | Robinson | 89/1 R |
| 3,571,605 | 3/1971 | Dobson et al. | 102/70.2 R |
| 3,643,545 | 2/1972 | Nahas | 42/84 |
| 3,712,230 | 1/1973 | Hoffmann | 42/1 R |
| 3,722,418 | 3/1973 | Hoffmann | 42/1 R |
| 3,748,955 | 7/1973 | Gatermann et al. | 102/70.2 R |
| 3,804,021 | 4/1974 | McGirr | 89/1 B |

*Primary Examiner*—Charles T. Jordan

*Attorney, Agent, or Firm*—R. S. Sciascia; Paul S. Collignon

[57] ABSTRACT

A device for simulating the firing of an automatic weapon by firing bullets both singularly and in bursts. A timing source provides electrical impulses which are randomly spaced in time and also provides pulses which are closely spaced to represent bursts. The bullets are fired by primers which are programmed by the timing source.

12 Claims, 4 Drawing Figures

AUTOMATIC WEAPON SIMULATOR

BACKGROUND OF THE INVENTION

The present invention relates to a device for simulating a pseudo-random sequence of small arms fire, including individual shots and bursts of machine gun fire.

Various devices have, in the past, been used to simulate the noise of a gun firing. In U.S. Pat. No. 2,836,919, entitled "Small Weapons Noise Simulator", which issued June 3, 1958, to Edwin R. DuBois, there is shown and described a small weapons noise simulator which can be attached to a weapon. An ammunition strip, which is comprised of wax impregnated paper, or cloth, is filled with powder to provide individual cartridge blanks. The ammunition strip is driven by gear means and the cartridge blanks are detonated in a firing chamber by an electric current.

Another weapon noise simulator is shown and described in U.S. Pat. No. 3,804,021, entitled, "Device For Firing Multiple Cartridges In A Time Sequence", which issued Apr. 16, 1974, to Robert McGirr. In this device, a plurality of blanks, or fully loaded ammunition, is positioned in a side by side relation in a housing and a pyrotechnic delay cord runs from cartridge to cartridge across the percussion cap end. Ignition of the pyrotechnic delay cord causes successive detonation of the cartridges.

Still another weapon noise simulator is shown and described in U.S. Pat. No. 3,712,230, entitled "Firing Equipment For Simulating Gunfire", which issued Jan. 23, 1973, to Oswald Hoffmann. A number of pyrotechnic devices are mounted in firing cups and a detonator is provided for each pyrotechnic device. A stepping switch is provided for switching a voltage to the various detonators.

SUMMARY OF THE INVENTION

The present invention relates to a device for simulating gunfire and more particularly to a device which will simulate the firing of an automatic weapon by firing both single shots and shots in bursts. A plurality of gun barrels are provided and each contains a bullet and a primer for firing the bullet. A sequencing system is provided which is based on the combined action of four multivibrators with different periods, started simultaneously. The multivibrators are connected to binary counters and decoders so that the switching or zero-crossing points of the multivibrators will determine a series of events. Although each multivibrator has a constant period, the combined sequence of their switching points create a pseudo-random pattern which repeats every 5 minutes. Each switching event is assigned, through the counters and decoders, to fire a single shot or to trigger a burst oscillator. Six burst oscillators are provided and are supplementary multivibrators running at 10 1 Hz. These burst oscillators are wired to discharge a burst of from 6 to 10 shots. The logic level signals are amplified and applied to the gates of silicon-controlled rectifiers (SCR's). The SCR's act as electronic switches to connect the primer squibs to a firing battery.

It is therefore a general object of the present invention to provide a device which will provide noise which will simulate the noise of an automatic weapon.

Another object of the present invention is to provide a device which will fire bullets singularly and in bursts.

Other objects, advantages and novel features of the present invention will become apparent from the following detailed description of the invention when considered in conjunction with the accompanying drawing.

DESCRIPTION OF THE PREFERRED EMBODIMENT

Figure 1:
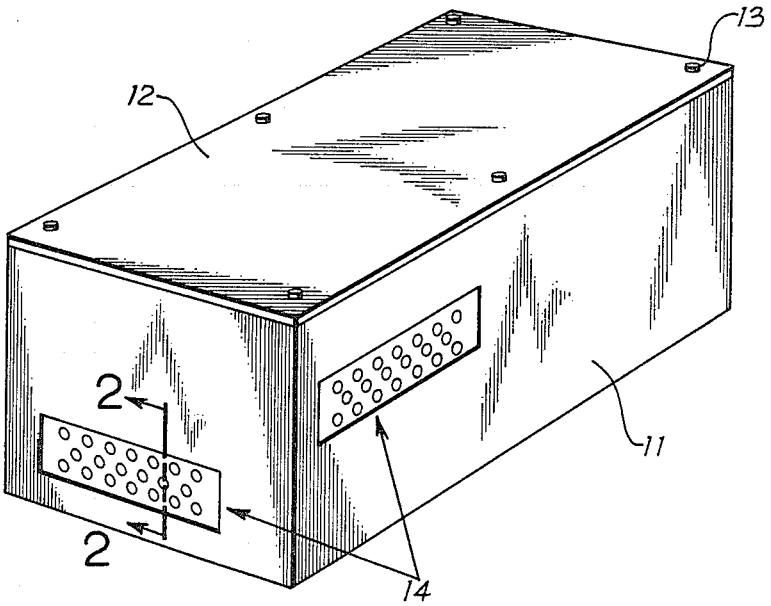
FIG. 1 is a perspective view of a perferred embodiment of the present invention.
Figure 2:
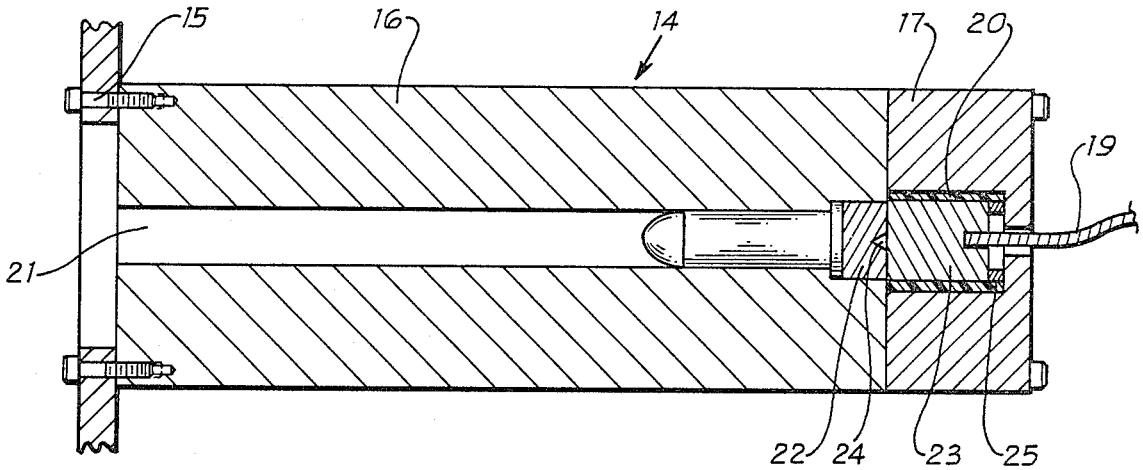
FIG. 2 is an enlarged sectional view taken on line 2—2 of FIG. 1.

Referring now to the drawings, there is shown in FIGS. 1 and 2 an embodiment of the invention which will fire 80 total shots including both individual shots and shots in bursts to simulate the firing of an automatic weapon. The type of weapon which is simulated is the M-60 machine gun, however, the type of weapon which is simulated and the number of shots to be fired is a matter of choice and should not be construed as limiting the invention. A housing 11, which might be of welded construction has a lid 12, attached by bolts 13, which permits access to the interior of housing 11. Lid 12 also serves as a mounting surface for the timing and sequencing circuits which will hereinafter be described.

Four barrel block assemblies 14 are attached, as by bolts 15, one each to the four vertical walls of housing 11. Barrel block assemblies 14 are identical assemblies consisting of a barrel block 16 and a breech plate 17. Each barrel block 16 contains 20 closely-spaced bores 21 of 0.356 inch diameter (.38 caliber). At the breech end of each bore, a counterbore is provided and is sized to accept a primer 22 with a mild interference fit. Each breech plate 17 contains a set of twenty recessed brass contact pins 23 with steel-point inserts 24 at the front end, and a hole for soldering in wire 19 at the rear end. Pins 23 are insulated from breech plate 17 by teflon sleeve 20 around the circumference and a nylon washer 25 at the rear. This insulation creates an individual electrical path to each primer 22 and insert points 24 indent the primers 22 and establish electrical continuity. Barrel block assemblies 14 are mounted in housing 11 in an overlapping pattern allowing one block 14 to fire from each of the four vertical walls of housing 11.

Figure 3:
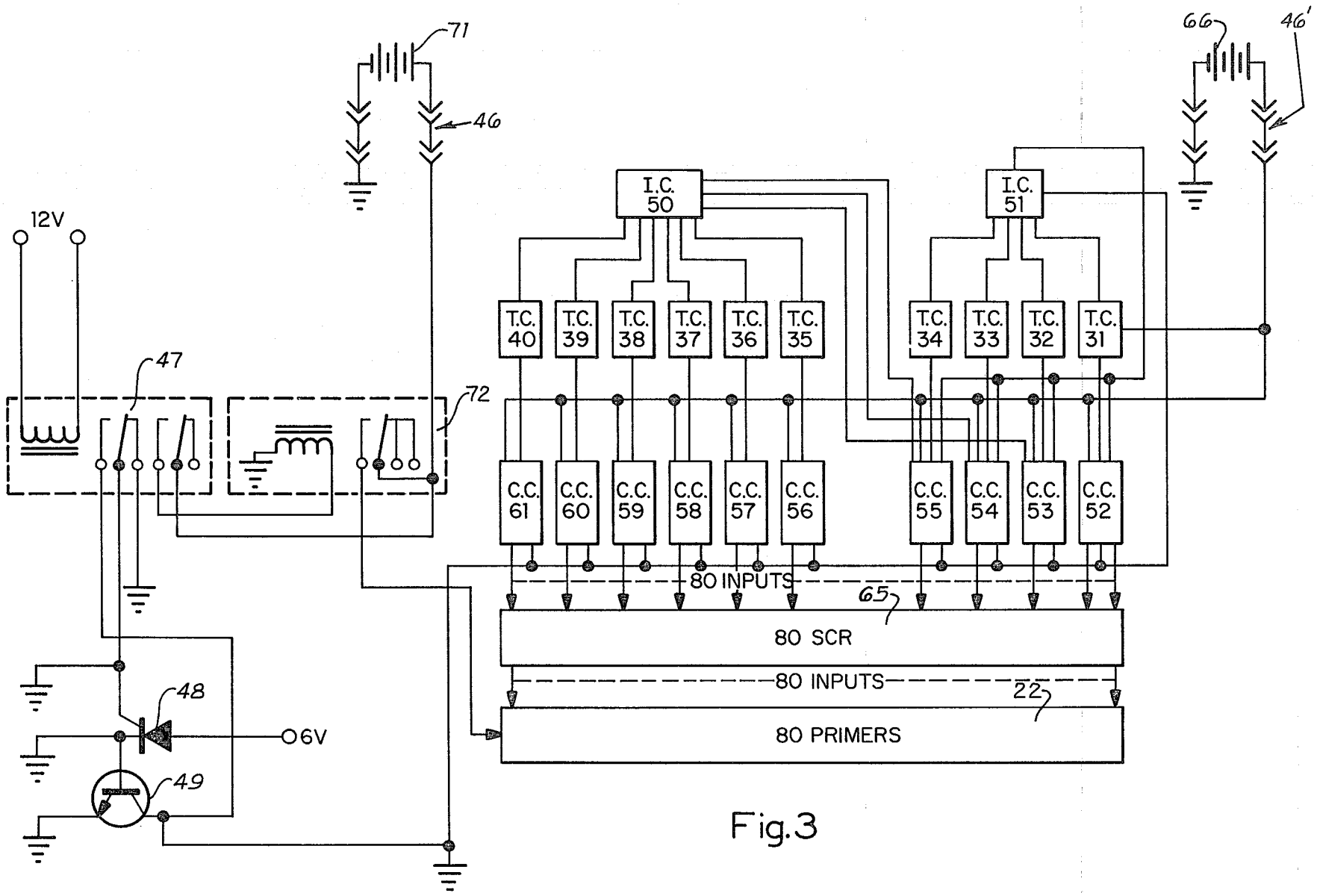
FIG. 3 is a block diagram of the circuitry for firing the embodiment shown in FIG. 1.

Referring now to FIG. 3 of the drawings, there is shown a circuit arrangement for firing the 80 primers 22 which are positioned in the four barrel block 16. Ten timing circuits 31–40 and ten control circuits 52–61 provide control signals to fire the 80 primers 22. The signals are produced in four series of specific sequences which operate simultaneously to provide different intervals between successive shots. Also, the control system provides six series of bursts containing six to ten shots each. The sequence of signals in each of the four series is fixed, however, the time interval between signals in each series can be easily changed. By way of example, the following shot program was used in one preferred embodiment of the present invention:

TABLE I

| Elapsed Time (sec.) | Single Shots | Bursts at 10 shots/sec |
|---|---|---|
| 19 | x | |
| 25 | x | |
| 33 | x | |

TABLE I-continued

| Elapsed Time (sec.) | Single Shots | Bursts at 10 shots/sec |
|---|---|---|
| 38 | | x (6 shots) |
| 46 | x | |
| 50 | x | |
| 66 | x | |
| 69 | | x (8 shots) |
| 75 | x | |
| 76 | x | |
| 92 | x | |
| 95 | x | |
| 99 | x | |
| 100 | x | |
| 115 | x | |
| 125 | x | |
| 132 | x | |
| 133 | x | |
| 138 | x | |
| 150 | x | |
| 152 | | x (6 shots) |
| 161 | x | |
| 171 | | x (7 shots) |
| 175 | x | |
| 190 | x | |
| 198 | x | |
| 200 | | x (10 shots) |
| 207 | x | |
| 209 | x | |
| 225 | x | |
| 230 | x | |
| 231 | x | |
| 247 | x | |
| 253 | x | |
| 264 | x | |
| 266 | x | |
| 275 | x | |
| 285 | | x (8 shots) |
| 297 | x | |
| 299 | x | |
| 300 | x | |

Figure 4:
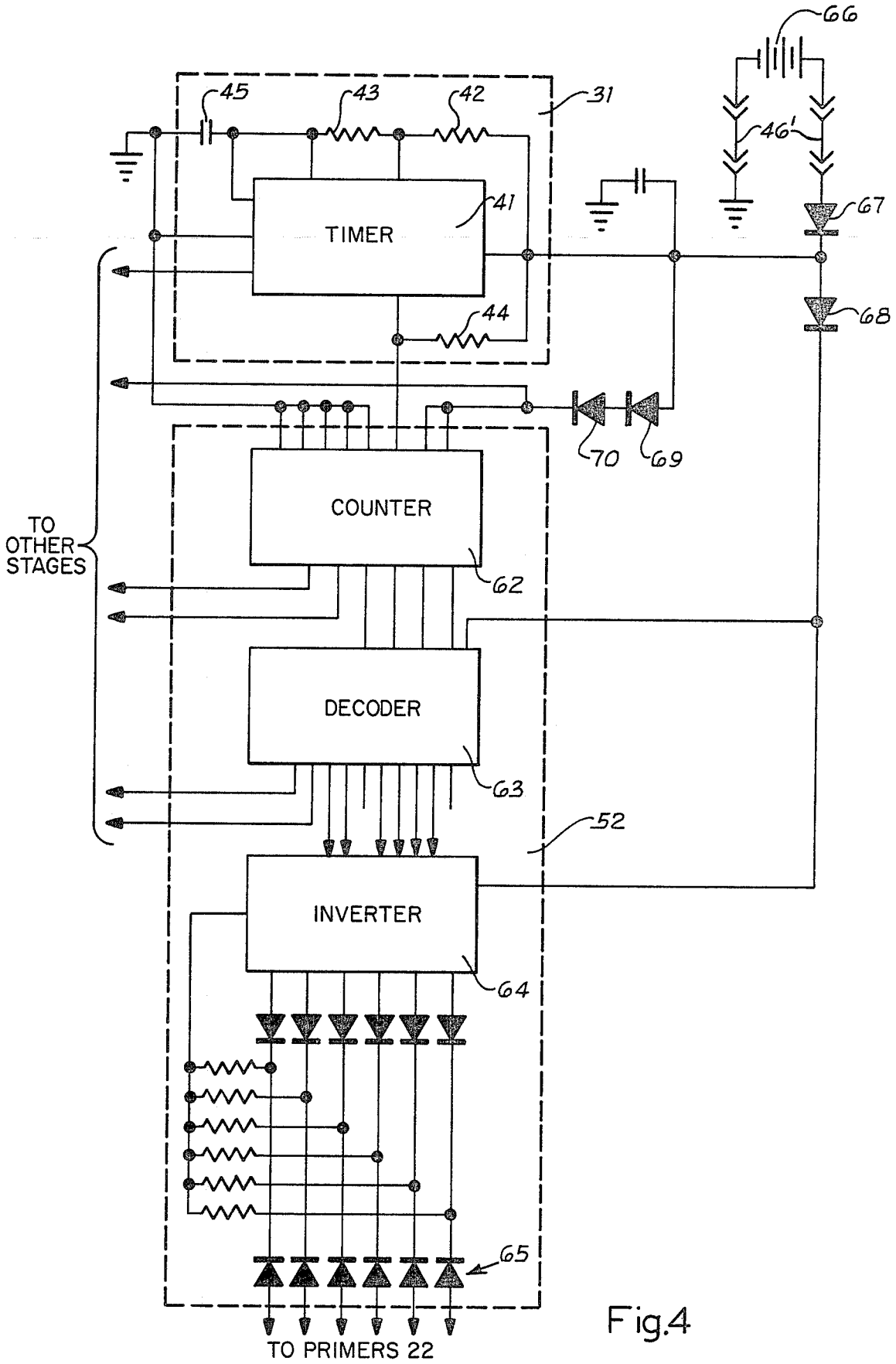
FIG. 4 is a diagram of one basic timing circuit and associated control circuit.

Referring still to FIGS. 3 and 4 of the drawings, four timing circuits 31–34 provide the time intervals for four basic firing sequences and six timing circuits 35–40 provide the time interval for the bursts. As shown in FIG. 4 of the drawings, each timing circuit consists of a multivibrator, such as an integrated circuit timer 41, resistors 42, 43, and 44, and a capacitor 45. Resistors 42 and 43, along with capacitor 45, determine the time interval between the output signals produced by a timing circuit. Resistor 44 provides a fixed minimum load for the integrated circuit device. By way of example, the components sizes for timing circuit 31 are chosen to provide time intervals of about 33 seconds between consecutive output signals and timing circuits 32, 33, and 34, produce time intervals of 25 seconds, 23 seconds and 19 seconds, respectively. Small changes in the timing intervals may be made by changing only one of the two timing resistors on the capacitor. Large changes in the timing interval require changing the sizes of both resistors and the capacitor. The six burst timing circuits 35–40 are identical and are similar to the basic timing circuit shown in FIG. 4 of the drawings and differ only in that they produce timing intervals of about 100 milliseconds. By way of example, the ten timers may be Signetics Type NE555.

The four basic timing circuits 31–34 are energized when arming plug 46 is inserted. The timing interval, however, is not started until relay 47 closes contacts which apply a positive voltage to the gate terminal of controlled rectifier 48. Whencontrolled rectifier 48 conducts, it provides the base current for transistor 49 and, when transistor 49 conducts, its collector reduces the voltage on the control circuit to which it is connected to near zero volts. The low state of the control line operates through integrated circuit 51 to set the control terminals of the four basic tuning circuits 31–34 to the high state which permits timing circuits 31–34 to start the timing sequences.

Ten control circuits 52–61 are provided and use the pulses produced by the timing circuits 31–40, respectively, to control the firing of the primers 22. The ten control circuits 52–61 are similar, and, as shown in FIG. 4 of the drawings, each consists of an integrated circuit counter 62, an integrated circuit decoder 63 and an integrated circuit inverter 64. The counters 62 accept serial inputs and each produces a four line parallel output. The decoders 63 accept the four line outputs from the counters to provide energized output terminals in sequence with the pulses produced by the time circuits. Ten identical synchronous counters are used in the system. Four of the ten counters produce the properly coded outputs for the basic timing circuit and the remaining six counters produce the coded outputs for the burst timing circuits. By way of example, the integrated circuit counters are the TTL Type SN74193.

Ten decoding devices 63 are used. Four of the ten decoding devices 63 have 16 output terminals and the remaining six devices have 10 output terminals. The number of output terminals on each decoding device is determined by the number of primers 22 the associated control circuit must fire. A ten-output decoder is used in the No. 1 basic control circuit because it is required to furnish only 8 control signals. The three remaining basic control circuits are equipped with 16-output decoders. Five of the six burst control circuits are equipped with 10-output decoders because each controls 8 or fewer primers. The remaining burst control circuit is equipped with a 16-output decoder because it must control 10 primers. The 10-output decoders are TTL integrated circuits, type SN7442 and the 16-output decoders are TTL integrated circuits, type SN74154.

One output of each decoder is in the low state and the remaining outputs are in the high state. At the start of the cycle all decoders are set such that the respective "0" terminals are in the low state. As the timing sequence progresses, consecutively higher numbered output terminals are switched to the low state. The low state of each output terminal is used for the control signal. A trigger voltage of $\pm 1.5$ volts is necessary to turn on the silicon-controlled rectifiers 65 which close the circuits to fire the primers 22. The trigger voltage is provided by the high state at the output terminals of the inverters 64, which, by way of example, might be TTL integrated circuit type SN74L04.

In the embodiment shown in FIGS. 3 and 4 of the drawings, a 6.25 volts, rechargeable nickel-cadmium battery 66, which has a capacity of 1.2 ampere-hours, supplies the energy for the timing and control units. Diodes 67, 68, 69 and 70 reduce the 6.25 volts available at the battery terminals to nominal 5 volts required by the integrated circuits in the control units.

The electrical energy required to fire the primers 22 and to operate relay 47 is furnished by a 12.5 volts rechargeable nickel-cadmium battery 71. This battery also has a capacity of 1.2 ampere-hours and the current drain is about 150 milliamperes except during the primer firing interval when a current as high as 10 amperes for a period of 5 milliseconds may be required.

OPERATION

One mode of tactical operation for the automatic weapon simulator disclosed herein includes deploying the simulator by use of a parachute. Either prior to aircraft takeoff, or during aircraft flight, the weapon simulator is armed by the insertion of arming plug 46. The firing sequence, however, is not started until starting relays 47 and 72 are energized. By way of example, relays 47 and 72 might be energized by an external voltage source which is initiated by impact of the weapon simulator on the ground. It should be understood, of course, that the weapon simulator could be deployed by means other than parachute. For example, the weapon could be used for training, for gorilla warfare, and the like, and could be deployed by ground forces.

Actuation of relay 72 connects battery 71 across the silicon-controlled rectifiers which deliver firing current to primers 22. Also actuation of the starting relays connect battery 66 with the timing circuits to begin the timing sequence. The four basic timing circuits 31–34 are energized when arming plug 46 is inserted and the energization of relay 47 closes contacts which apply a positive voltage to the gate terminal of controlled rectifier 48. When rectifier 48 conducts, it provides the base current for transistor 49. When transistor 49 conducts, its collector reduces the voltage on the control circuit to which it is connected to near zero volts. The low state of the control line operates through integrated circuit 51 to set the control terminals of the four basic timing circuits 31–34 to the high state which permits the timing circuits to start the timing sequences for the weapon simulator. The burst timing circuits 35–40 continue to be held inoperative until the proper time in the sequence is reached. integrated circuit 50 performs the same function for timing circuits 35–40 which integrated circuit 50 performs for timing circuits 31–34, however, the burst timing circuits 35–40 continue to be held inoperative until the proper time in the sequence is reached.

The outputs from each timing circuit is applied to a separate counter device 62 which accepts a serial input and produces a four line parallel output. A decoder 63 accepts the four line output from its associated counter to provide an output which is in sequence with the pulses produced by the timing circuits. One output of each decoder is in the low state and the remaining outputs are in the high state. As the timing sequence progresses, consecutively higher numbered output terminals are switched to the low state and this low state of each output terminal is used for the control signal. An inverter 64 is connected with the output terminals of each decoder 63 and supplies the trigger voltage to turn on the silicon-controlled rectifiers 65 which close the circuits to fire primers 22.

TABLE I shows the timing sequence for an embodiment of the invention which has been designed and built to fire 80 shots. It should be understood, however, that both the number of shots and the firing sequence is a matter of design choice and can be readily changed by one skilled in the art.

It can thus be seen that the weapon simulator described herein provides a pseudo-random sequence of small arms fire and thus simulates the firing of an automatic weapon, such as a machine gun.

Obviously many modifications and variations of the present invention are possible in the light of the above teachings. It is therefore to be understood that the invention may be practiced otherwise than as specifically described.

We claim:

1. A device for simulating the firing of an automatic weapon comprising, a plurality of pyrotechnic devices, means for detonating said pyrotechnic devices, and timing means providing both single signals and bursts of signals connected with said means for detonating whereby said pyrotechnic devices are detonated to simulate the firing of an automatic weapon.

2. A device for simulating the firing of an automatic weapon as set forth in claim 1 wherein each said pyrotechnic device is mounted in a separate firing chamber.

3. A device for simulating the firing of an automatic weapon as set forth in claim 1 wherein said pyrotechnic devices are small arm ammunition and said means for detonating includes a primer detonatable by an electric current.

4. A device for simulating the firing of an automatic weapon comprising, a plurality of pyrotechnic devices, a plurality of detonators positioned one each adjacent each said pyrotechnic device, a voltage source connectable with said detonators, and timing means for selectively connecting said detonators with said voltage source to detonate said detonators and fire said pyrotechnic devices at different time interval to simulate the firing of an automatic weapon.

5. A device for simulating the firing of an automatic weapon as set forth in claim 4 wherein said timing means includes a plurality of multivibrators having different time periods.

6. A device for simulating the firing of an automatic weapon as set forth in claim 4 wherein said pyrotechnic devices are small arm ammunition and said detonators are primers detonatable by an electric current.

7. A device for simulating the firing of an automatic weapon comprising, a plurality of pyrotechnic devices, a plurality of detonators positioned one each adjacent each said pyrotechnic device, a source of voltage connectable with each said detonator, a plurality of switching means connected one each between said source of voltage and each said detonator, and timing means for selectively actuating said switching means to connect said detectors with said source of voltage for detonating said detonators and firing said pyrotechnic devices thereby simulating the firing of an automatic weapon.

8. A device for simulating the firing of an automatic weapon as set forth in claim 7 wherein said timing means includes a plurality of multivibrators having different time periods.

9. A device for simulating the firing of an automatic weapon as set forth in claim 8 wherein said switching means are silicon-controlled rectifiers.

10. An automatic weapon simulator comprising, a container having a plurality of gun barrels, a bullet and an electrical primer contained in each said gun barrel, a source of voltage, circuit means including a plurality of switching means connected one each between said source of voltage and each said primer, and timing means for selectively actuating said switching means and connecting said source of voltage to said electrical primers thereby detonating said primers and firing said bullets thereby simulating the firing of an automatic weapon.

11. An automatic weapon simulator as set forth in claim 10 wherein said timing means includes a plurality of multivibrators having different time periods.

12. An automatic weapon simulator as set forth in claim 11 wherein said switching means are silicon-controlled rectifiers.

* * * * *